United States Patent [19]

Chang et al.

[11] Patent Number: 4,664,824

[45] Date of Patent: May 12, 1987

[54] PHENATE PRODUCT AND PROCESS

[75] Inventors: Yuehsiung Chang, Naperville; Larry C. Satek, Wheaton, both of Ill.

[73] Assignee: Amoco Corporation, Chicago, Ill.

[21] Appl. No.: 818,862

[22] Filed: Jan. 14, 1986

[51] Int. Cl.[4] ..... C10M 129/00

[52] U.S. Cl. ..... 252/42.7; 568/23; 568/40; 568/75

[58] Field of Search ..... 252/42.7, 46.4; 568/75, 568/23, 40

[56] References Cited

U.S. PATENT DOCUMENTS

| | | | |
|---|---|---|---|
| 3,178,368 | 4/1965 | Hanneman | 252/42.7 |
| 3,367,867 | 2/1968 | Abbott et al. | 252/42.7 |
| 3,725,381 | 4/1973 | Sakai et al. | 252/42.7 |
| 3,779,920 | 12/1973 | DeVries | 252/42.7 |
| 3,923,670 | 12/1975 | Crawford | 252/42.7 |
| 3,966,621 | 6/1976 | Watkins et al. | 252/42.7 |
| 4,123,371 | 10/1978 | Hori et al. | 252/42.7 |

*Primary Examiner*—William R. Dixon, Jr.
*Assistant Examiner*—Cynthia A. Prezlock
*Attorney, Agent, or Firm*—William C. Clarke; William H. Magidson; Ralph C. Medhurst

[57] ABSTRACT

There is provided a process for the preparation of an overbased sulfurized alkaline earth metal alkylphenate product which provides improved bright stock solubility and reduced foam stability, the overbased alkylphenate products produced thereby, and lubricating oil compositions containing such overbased alkylphenate products. According to the process, a mixture of an alkylphenol having an alkyl group containing from about 8 to about 40 carbon atoms, elemental sulfur, a dihydric alcohol containing from 2 to 6 carbon atoms, an alkaline earth metal compound, a lubricating oil, and a high boiling point linear monohydric alcohol having from about 18 to about 60 carbon atoms is heated to a first temperature within the range of about 121° C. (250° F.) to about 204° C. (400° F.); the resulting intermediate product mixture is contacted with carbon dioxide at a second temperature below 193° C. (380° F.) to provide a carbonated product mixture; the carbonated product mixture is treated to remove unreacted alkylphenol, unreacted dihydric alcohol, and substantially all of the remaining water of reaction to provide a final product mixture; and the final product mixture comprising said overbased alkylphenate and substantially all of the high boiling point linear monohydric alcohol is recovered.

29 Claims, 1 Drawing Figure

PHENATE PRODUCT AND PROCESS

CROSS-REFERENCE TO RELATED APPLICATION

This patent application is being filed in the U.S. Patent and Trademark Office concurrently with U.S. patent application Ser. No. 818,864, which is directed to the treatment of an overbased sulfurized alkaline earth metal alkylphenate with a small amount of a high boiling point linear monohydric alcohol in order to improve the bright stock solubility of the overbased alkylphenate.

FIELD OF THE INVENTION

The present invention relates to an improved additive for lubricating oils which is effective in preventing engine deposits, reducing residual reaction solids, providing improved processibility during its preparation, and providing better bright stock solubility and reduced foam stability. More particularly, the present invention relates to an oil-soluble overbased sulfurized metal alkylphenolate (phenate) product which is characterized by its solubility in bright stocks, especially those employed in marine diesel engines, and its ability to minimize foam stability, to the process for preparing such product, and to lubricants containing such product.

DESCRIPTION OF THE PRIOR ART

For many years metal salts of phenolic compounds have been utilized as additives for mineral-lubricating oil compositions that are used to lubricate internal combustion engines. For example, calcium salts of phenols are used as detergents for dispersing sludges and keeping internal combustion engines clean. Metal phenates are used in combination with various other additives in a lubricating oil to improve the detergency characteristics of the lubricating oil, to reduce the formation of harmful deposits, to improve the oxidation resistance of the oil, and to reduce engine wear.

In U.S. Pat. No. 2,680,097, Stewart discloses a method for preparing calcium and lead salts of phenols wherein a calcium or lead basic-reacting substance, such as an oxide or a hydroxide of calcium or lead, is reacted with a phenol in a reaction medium of a dihydric alcohol containing up to 6 carbon atoms. This method comprises a one-step process providing high conversions. This patent also discloses the preparation of sulfurized calcium phenates.

In U.S. Pat. No. 3,036,971, Otto teaches the carbonated derivatives of basic sulfurized calcium phenates. The basic sulfurized calcium phenates are treated with $CO_2$. Such carbonation treatment improves substantially the normal antioxidant properties of the basic salts.

In U.S. Pat. No. 3,178,368, Hanneman discloses a process for the preparation of an overbased sulfurized metal phenate, which comprises: handling and heating to a temperature within the range of 66° C. (150° F.) to 88° C. (190° F.) a mixture of an alkylphenol, a basic alkaline earth metal sulfonate, a high molecular weight monohydric alcohol containing from 8 to 18 carbon atoms, a lubricating oil, and sulfur; adding an alkaline earth metal oxide or hydroxide, e.g., hydrated lime, to the mixture; heating the mixture to a temperature within the range of 121° C. (250° F.) to 149° C. (300° F.) and adding ethylene glycol; heating to a temperature of about 171° C. (340° F.) to remove water of reaction; cooling the mixture and adding carbon dioxide at a temperature within the range of 121° C. (250° F.) to 149° C. (300° F.); removing uncombined carbon dioxide from the carbonated mixture; and heating the carbonated mixture at a temperature within the range of 149° C. (300° F.) to 199° C. (390° F.) to remove ethylene glycol, water, and high molecular weight alcohol therefrom. This patent provides that it is desirable that the final oil blend contains a portion of the high molecular weight alcohol, pointing out that it may be removed in its entirety or amounts up to 100% of the initial charge may remain in the final composition. The initial charge of this high molecular weight alcohol varies from 10 to 75 wt % of the alkylphenol charged.

In U.S. Pat. No. 3,336,224, Allphin, Jr., discloses a process for preparing a highly overbased carbonated sulfurized alkaline earth metal phenate that is an improvement over the phenate prepared by the process of U.S. Pat. No. 3,178,368. The improvement comprises increasing the amount of calcium by at least 0.5 wt. % calcium, and generally at least about 1.0 wt % calcium, by adding calcium or calcium hydride at elevated temperatures to the overbased phenate. The increased available calcium provides greater alkalinity.

In U.S. Pat. No. 3,464,970, Sakai, et al., disclose a process for preparing an overbased sulfurized calcium phenate, which process comprises mixing at least one phenolic compound, a dihydric alcohol having 2 to 6 carbon atoms, elementary sulfur, and calcium oxide or calcium hydroxide with 50 to 1,000% by weight, based on said phenolic compound, of a higher alcohol, reacting the mixture at a temperature within the range of 110° C. (230° F.) to 150° C. (302° F.), removing generated hydrogen sulfide, maintaining the temperature at 20° C. (68° F.) to 150° C. (302° F.) after completion of the sulfurization reaction, continuing the reaction until the calcium reagent has been reacted completely, distilling water of reaction and unreacted dihydric alcohol at below 150° C. (302° F.) under reduced pressure, heating the distillation residue together with carbon dioxide, and then removing the higher alcohol and a small amount of precipitate. This patent provides that the higher alcohol is used as a solvent and is a straight chain or branched aliphatic saturated monohydric alcohol having 9 to 18, preferably 9 to 14, carbon atoms and is required to have a boiling point that is higher than that of the dihydric alcohol.

In U.S. Pat. No. 3,725,381, Sakai, et al., teach a process for preparing an overbased sulfurized phenate, which process comprises mixing at least one phenolic compound, elementary sulfur, an alkaline earth metal oxide or hydroxide, and a dihydric alcohol having 2 to 6 carbon atoms; heating the resultant mixture at a temperature within the range of 110° C. (230° F.) to 200° C. (392° F.) in the presence of a higher alcohol; removing substantially all of the water of reaction and a major portion of the unreacted dihydric alcohol by distilling the reaction mixture at a temperature below 200° C. (392° F.), and heating the distillation residue at a temperature within the range of 70° C. (150° F.) to 200° C. (392° F.) together with carbon dioxide in the presence of the higher alcohol. This patent provides that the higher alcohol is used as a solvent and is a straight chain or branched aliphatic saturated monohydric alcohol having 9 to 24 carbon atoms and a boiling point higher than that of the dihydric alcohol. The higher alcohol should be used as a solvent in the sulfurization and metal addition reactions in an amount of at least 0.5, preferably at least 3.0, times the weight of the phenolic compound used. It must be used as the solvent in the subsequent carbon dioxide treatment in the amount of at least 10.5 times the weight of the phenolic compound. This patent further provides that economically it is desirable to recover a major portion of, or the entire amount of, the higher alcohol.

In U.S. Pat. No. 3,966,621, Watkins, et al., disclose a process for preparing a colloidal suspension in oil of a Group II metal carbonate together with a Group II metal sulfurized phenate as dispersant, which process comprises: forming a reaction mixture comprising a Group II metal base compound, either sulfur and one or more hydrocarbyl substituted phenols or one or more sulfurized phenols, a diol (ethylene glycol), a $C_1$ to $C_{15}$ monoalcohol and/or a $C_8$ to $C_{20}$ ether alcohol, and oil; heating the mixture to a temperature within the range of 110° C. (230° F.) to 180° C. (356° F.); introducing carbon dioxide into the reaction mixture when the temperature thereof is less than 140° C. (284° F.); reducing the amount of the water of reaction below 0.3 wt %, based on the total weight of the reaction mixture, before the introduction of carbon dioxide has been completed; and thereafter removing the diol and monoalcohol or ether alcohol.

In U.S. Pat. No. 4,412,927, Demoures, et al., teach a process for preparing a detergent-dispersant composition from an alkaline earth metal alkylbenzene sulfonate, a sulfurized alkylphenate of an alkaline earth metal, an alkaline earth metal compound, an alkalene glycol optionally being present in mixture with up to about 200% of its weight of a monoalcohol having a boiling point of more than 120° C. (248° F.), and carbon dioxide, which process comprises: carbonating with carbon dioxide at a temperature within the range of about 100° C. (212° F.) to 250° C. (482° F.) a reaction medium comprising the other reactants in a dilution oil; removing the alkalene glycol; and separating the superalkalinized metallic detergent-dispersant. This patent provides that the alkalene glycols "can possibly be present in mixture with up to 200 percent of their weight of a monoalcohol such as ethylhexanol, tridecyl alcohol, the $C_8$–$C_{14}$ oxo alcohols, and, in general, alcohols having a boiling point of more than 120° C., and preferably more than 150° C."

In U.S. Pat. No. 4,518,807, Hori, et al., teach a process for preparing a basic alkaline earth metal phenate, which process comprises reacting a phenol, a dihydric alcohol, and alkaline earth metal oxide or hydroxide, and optionally elemental sulfur at a temperature within the range of 60° C. (140° F.) to 200° C. (392° F.) to achieve addition of the metal to the phenol; adding water to the reactants while they are allowed to react, the water being added in an amount within the range of 0.01 to 10 moles of water per mole of the alkaline earth metal; and thereafter treating the reaction product with carbon dioxide at a temperature within the range of 50° C. (122° F.) to 230° C. (446° F.). This patent teaches that a higher alcohol having from 8 to 24 carbon atoms is used as a diluent.

Phenates are utilized in lubricating oils to neutralize acids that are formed during engine operations. Overbased phenates, i.e. high-basicity phenates, are needed for lubricating oils that are employed in marine diesel engines, which operate on high-sulfur fuels. Generally, such high basicity is achieved by overbasing a sulfurized phenate using lime and carbon dioxidate. The overbasing is a difficult processing step and often results in products that are hard to filter and sometimes suffer from their poor solubility in bright stocks for marine engine applications and their tendency to increase from stability.

It has been found that incorporating a small amount of selected organic compounds, such as a high boiling point linear monohydric alcohol into the reaction mixture and maintaining substantially all of the high boiling point linear monohydric alcohol throughout the process so that substantially all of the monohydric alcohol remains in the product promotes phenate reactions, enhances stripping, increases the filtration rate, reduces product viscosity, and improves product compatibility and provides a product that has improved bright stock solubility and reduced foaming tendency.

SUMMARY OF THE INVENTION

Disclosed is a process for the preparation of an overbased sulfurized metal phenate product that is characterized by its solubility in bright stocks, especially those used in marine diesel engine applications, and its ability to provide reduced foam stability. The process comprises heating a reaction mixture of an alkylphenol having an alkyl group containing from about 8 to about 40 carbon atoms, elemental sulfur, a dihydric alcohol containing from 2 to 6 carbon atoms per molecule, an alkaline earth metal compound, an oil, and a small amount of a high boiling point linear monohydric alcohol having from about 18 to about 60 carbon atoms per molecule to a first temperature within the range of about 121° C. (250° F.) to about 204° C. (400° F.) and maintaining said reaction mixture at said first temperature for a period of time within the range of about 1 hr to about 5 hr to form an intermediate product mixture; contacting the intermediate product mixture with carbon dioxide at a second temperature that is below 193° C. (380° F.) to provide a carbonated product mixture; removing substantially all of the remaining water of reaction and large portions of the unreacted alkylphenol and of the unreacted dihydric alcohol from the carbonated product mixture to provide a final product mixture; and recovering the final product mixture comprising the overbased sulfurized metal phenate and substantially all of the high boiling point linear monohydric alcohol that was used in the reaction mixture.

The invention is directed also to the use of this final product mixture as an additive for lubricating oils, such as those used in diesel engines, and particularly those that are used in marine engine applications, and to the finished lubricating oils.

The presence of the high boiling point linear monohydric alcohol in the intermediate product mixture and final product mixture improves processability and product compatability. The phenate reactions are increased; the stripping is enhanced; the filtration rate is increased; the viscosity of the product is reduced, foam stability is reduced; and bright stock solubility is improved.

BREIF DESCRIPTION OF THE DRAWING

The accompanying FIGURE is a schematic flow diagram of an embodiment of the process of the present invention, which embodiment represents a continuous processing scheme for the process. Since the FIGURE is a schematic flow diagram, various pieces of auxiliary equipment, such as pumps, valves, heat exchangers, and the like, are not shown; however, those skilled in the art will recognize easily where such auxiliary equipment would be used.

DETAILED DESCRIPTION OF THE INVENTION

Figure 1:
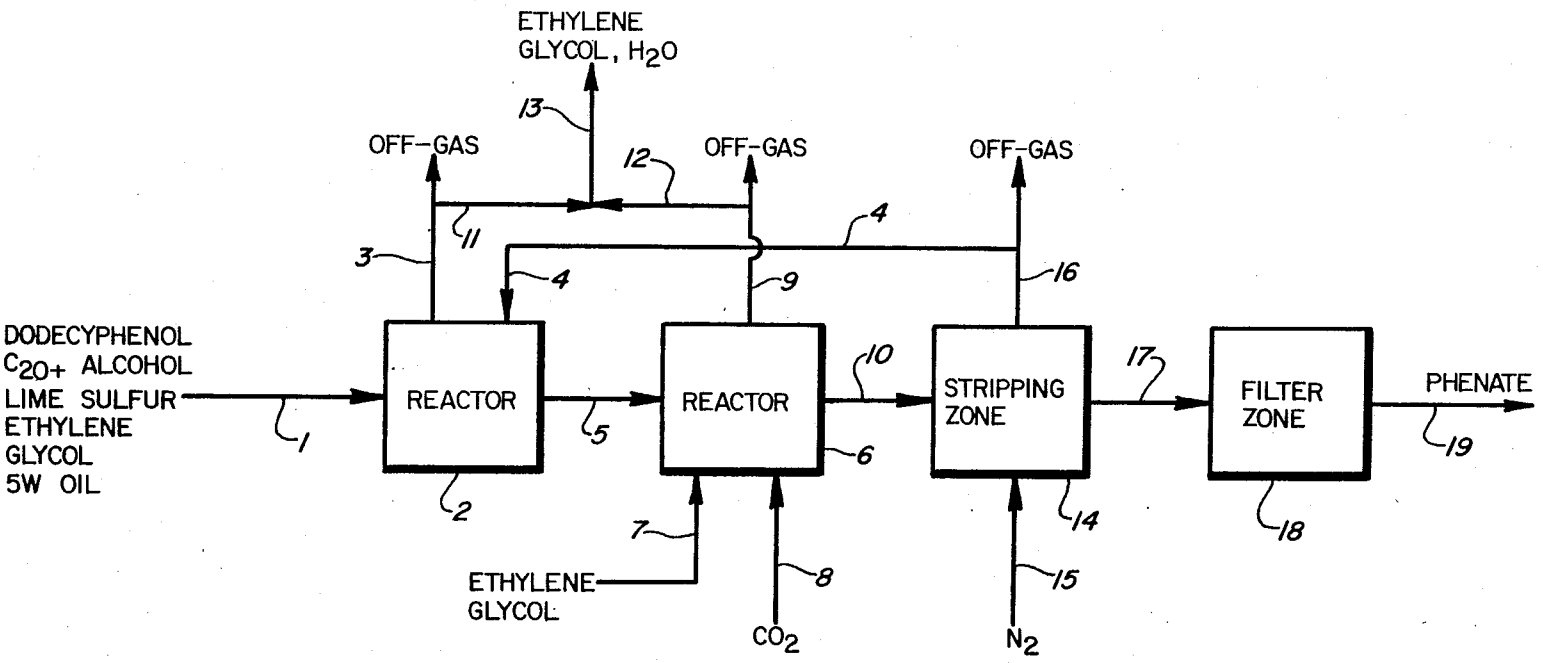

According to the present invention, there is provided a process for preparing an overbased sulfurized metal phenate which provides improved processability and product compatibility, the improved overbased sulfurized metal phenate that is produced by the process, and lubricating oil compositions, especially those that are used for marine diesel engine applications, that contain additive amounts of the aforesaid phenates.

It has been found that the incorporation of a small amount of a high boiling point linear monohydric alcohol into the reaction mixture and the maintenance of substantially all of the monohydric alcohol in the mixture during the sulfurization and metal addition reactions and subsequent carbonation reaction and stripping steps so that substantially all of the monohydric alcohol that was put into the reaction mixture is present in the final product mixture and results in a lubricating oil additive that provides improved solubility in bright stock and reduced foaming.

As used herein, the phrase "substantially all of the monohydric alcohol" refers to at least about 90% of the monohydric alcohol that was used in the process. Typically, about 90 to about 100% of the monohydric alcohol that is in the feed mixture or first mixture remains in the final product mixture.

It has been found that if the high boiling point linear monohydric alcohol is present in the feed mixture in an amount within the range of about 2 wt % to about 10 wt %, preferably about 3 wt % to about 5 wt %, based on the total weight of the alkylphenol, and substantially all of the monohydric alcohol remains throughout the process and is present in the final product mixture, the above-mentioned advantages occur.

The feed mixture, i.e. the first mixture, contains an alkylphenol, a dihydric alcohol, an alkaline earth metal compound, a lubricating oil, and a high boiling point linear monohydric alcohol.

The alkylphenols that are used in the process of the present invention are of the formula $R(C_6H_4)OH$, wherein R is a straight chain or branched chain alkyl group having from 8 to 40 carbon atoms, preferably from 10 to 30 carbon atoms, and the moiety $(C_6H_4)$ is a benzene ring. Examples of suitable alkyl groups are octyl, decyl, dodecyl, tetradecyl, hexadecyl, triacontyl, etc., up to tetracontyl. Dedecylphenol is a preferred alkylphenol. It is to be understood that the term "an alkylphenol" is used herein to represent one or more of such alkylphenols.

The dihydric alcohols that are used in the process of the present invention are the gylcols containing from 2 to 6 carbon atoms. Suitable glycols are ethylene glycol; propylene glycol; butane diol-2,3; pentane diol-2,3; and 3-methylbutane diol-1,2. Ethylene glycol is the preferred dihydric alcohol.

The alkaline earth metal compounds that can be used in the process of the present invention are the oxides and hydroxides of calcium, barium, and magnesium. The preferred alkaline earth metal is calcium and the preferred alkaline earth metal compound is calcium hydroxide, as hydrated lime, particularly for continuous feeding.

A lubricating oil is used as a reaction diluent. This lubricating oil can be any lubricating oil that is used in the final lubricating oil formulation provided by the present invention. Such lubricating oils can be, for example, a 5W, 10W, or even a 40W oil and include naphthenic base, paraffin base, and mixed base mineral oils and other hydrocarbon lubricants, such as synthetic lubricating oils and lubricating oil derived from coal products. A 5W oil is preferred.

The high boiling point linear monohydric alcohol that is employed in the process of the present invention is a high boiling point linear monohydric alcohol having from about 18 to about 60 carbon atoms, preferably about 18 to about 24 carbon atoms. The boiling point should be sufficiently high to minimize removal of any appreciable amount of the monohydric alcohol from the first mixture, intermediate product mixture, or final product mixture. The term "high boiling point linear monohydric alcohol" is used herein to represent a single monohydric alcohol or a mixture of such alcohols. A particularly suitable monohydric alcohol is "Alfol (Trademark) $C_{20+}$ alcohol," a mixture of alcohols containing primarily (about 70%) $C_{20}$ alpha-alcohol. "Alfol (Trademark) $C_{20+}$ alcohol" can be obtained from Vista Chemical Co., Houston, Tex.

The elemental sulfur is used in the form of a solid, such as flowers of sulfur. Molten sulfur could be used also.

The process of the present invention can be carried out by first forming a mixture of sulfur, alkylphenol, alkaline earth metal compound, dihydric alcohol, and linear monohydric alcohol, along with a reaction diluent, such as a 5W oil, and heating the mixture at a temperature within the range of about 121° C. (250° F.) to about 204° C. (400° F.) for a period of time within the range of about 1 hr to about 5 hr, preferably at a temperature within the range of about 166° C. (330° F.) to about 188° C. (370° F.). Sulfurization and metal addition reactions occur.

Conveniently, the alkaline earth metal compound and dihydric alcohol can be added at more than one time during the process. For example, an amount of about 30% to about 50% of the total amount of each that will be used can be used in the original first mixture and the remaining about 70% to about 50% of the total amount of each is added after the start of the process, but prior to the termination of the subsequent carbonation step that is discussed hereinafter.

Carbonation takes place by introducing carbon dioxide into the intermediate product mixture at a temperature below about 193° C. (380° F.). Typically, the temperature for carbonation is within the range of about 149° C. (300° F.) to about 182° C. (360° F.); preferably, within the range of about 166° C. (330° F.) to about 177° C. (350° F.). In order to achieve small colloidal particle size, the rate at which carbon dioxide reacts with the alkaline earth metal compound should be preferably less than 0.5 mole of carbon dioxide per mole of alkaline earth metal compound per hour. A suitable rate would fall within the range of about 0.05 to about 0.4 mole of carbon dioxide per mole of alkaline earth metal compound per hour. Normally, the carbonation is continued until saturation or until saturation is substantially complete; i.e., at least about 95% completed.

A substantial amount of water of reaction that is formed during the process is removed, along with hydrogen sulfide, as the process proceeds.

At the end of the carbonation, the final product mixture is stripped to remove the remaining unreacted dihydric alcohol and unreacted alkylphenol. The stripping is carried out at a temperature within the range of about 204° C. (400° F.) to about 260° C. (500° F.), preferably about 232° C. (450° F.) to about 249° C. (480° F.), and is facilitated by applying a vacuum, nitrogen purge, or a combination of a vacuum and nitrogen purge.

The resultant stripped final product mixture comprising the overbased sulfurized metal phenate and substantially all of high boiling point linear monohydric alcohol is filtered to remove solids (oil-insoluble compounds and materials) from the final product mixture. Typically, during commercial operations, a rotary vacuum filter is employed. A sparkler filter can be used also to polish the final product.

It is to be emphasized that the above process steps are carried out in a manner and under conditions that will allow substantially all of the high boiling point linear monohydric alcohol to remain in the first mixture, intermediate product mixture, and final product mixture in order to provide the characteristics of improved processability and product compatibility.

In the following Table I, the amounts of reactants that are used in the process of the present invention are presented. The amount of each reactant is expressed in terms of moles of reactant per mole of alkylphenol.

TABLE I

REACTANT AMOUNTS

| Reactant | Amount, moles per mole alkylphenol | |
|---|---|---|
| | Broad Range | Preferred Range |
| Alkylphenol | 1.0 | 1.0 |
| Sulfur | 1.0–2.0 | 1.3–1.6 |
| Alkaline earth metal compound | 1.2–2.0 | 1.6–1.8 |
| Dihydric alcohol | 1.0–2.0 | 1.2–1.7 |
| Monohydric alcohol | 0.01–0.1 | 0.02–0.05 |
| Carbon dioxide | 0.5–1.3 | 0.9–1.1 |

NOTE:
The diluent oil comprises about 20 to about 40 wt % of the reaction mixture.

Typically, the final product mixture will contain the high boiling point linear monohydric alcohol in an amount within the range of about 1 wt % to about 5 wt %, based on the weight of the overbased sulfurized alkaline earth metal alkylphenate. Preferably, the amount will be within the range of about 1.5 wt % to about 2.5 wt %, based on the weight of the overbased alkylphenate.

The above processing steps can be carried out by either a batch or continuous processing method. Advantageously, a continuous processing system provides better control of process parameters.

The accompanying figure presents in a schematic flow diagram an embodiment of the process of the present invention wherein a continuous processing scheme is employed. The FIGURE and its embodiment are presented for the purpose of illustration only and are not intended to limit the scope of the present invention.

A mixture of dodecylphenol, lime, sulfur, ethylene glycol, Alfol (Trademark) $C_{20+}$ alcohol, and a 5W oil as diluent is passed through line 1 into reactor 2 where it is heated at a temperature of about 182° C. (360° F.) for a period of time within the range of about 1 hr to about 2 hr. Only about 30% of the ethylene glycol that is used in the process is present in the mixture in line 1. Off-gas is removed from reactor 2 via line 3, while condensate from a subsequent stripping operation is introduced into reactor 2 via line 4.

An intermediate product mixture is withdrawn from reactor 2 by way of line 5 and is passed by line 5 into reactor 6 where it contacts the remaining 70% of the ethylene glycol. This second charge of ethylene glycol is introduced via line 7 into reactor 6, and carbon dioxide is introduced into reactor 6 via line 8. A portion of the lime used in the process may also be introduced into reactor 6. The contents of reactor 6 are heated at a temperature of about 182° C. (360° F.) for a period within the range of about 1 hr to 2 hr. Off-gas is removed from reactor 6 by way of line 9 and carbonated product mixture is withdrawn from reactor 6 by way of line 10. Reactor condensate obtained from the off-gas from reactor 2 and reactor condensate obtained from the off-gas from reactor 6, containing water of reaction and some ethylene glycol, are combined via lines 11, 12, and 13 and are withdrawn from the process via line 13. The ethylene glycol after water removal can be recycled for use in the process.

The carbonated product mixture is passed by way of line 10 into stripping zone 14, where nitrogen stripping is employed to remove substantially all of the remaining water of reaction and major portions of the unreacted dodecylphenol and unreacted ethylene glycol. Stripping is carried out at a temperature within the range of about 238° C. (460° F.) to about 249° C. (480° F.) for about 0.5 hr. Nitrogen is passed into stripping zone 14 via line 15 and the water of reaction, the unreacted ethylene glycol, and the unreacted dodecylphenol are withdrawn in the off-gas via line 16. Stripper condensate obtained from the off-gas and containing unreacted dodecylphenol and unreacted ethylene glycol is passed via line 4 to reactor 2.

Stripped product mixture is passed from stripping zone 14 via line 17 into filter zone 18, whereby solids are removed from the stripped product mixture to provide the finished or final product mixture that is withdrawn by line 19. The finished product mixture comprises the overbased sulfurized calcium dodecylphenate and substantially all of the Alfol (Trademark) $C_{20+}$ alcohol that was charged to reactor 2.

The finished product mixture of the process of the present invention is used suitably as an overbased detergent additive for lubricating oils, particularly for lubricating oils for marine diesel engines. The amount of this additive employed in a lubricating oil composition should be a minor proportion of the composition. Typically, it should be present in an amount within the range of about 4 wt % to about 40 wt %, based upon the weight of the total composition. Preferably, it should be present in an amount within the range of about 10 wt % to about 20 wt %, based upon the weight of the total composition.

The lubricating oil compositions of this invention can be prepared easily by mixing the overbased sulfurized alkaline earth metal alkylphenate prepared as a concentrate into a suitable lubricating oil or lubricating oil composition. Of course, the concentration of the sulfurized alkaline earth metal alkylphenate in the lubricating oil can vary, depending upon the characteristics of the lubricating base oil used and the type of sulfurized alkaline earth metal alkylphenate selected.

Examples of lubricating oils useful as base oils in the present invention are natural oils, which can be naphthenic base, paraffin base, and mixed base, and synthetic oils. Other hydrocarbon oils can be derived from coal sources and synthetic compounds, such as alkylene polymers, carboxylic acid esters, and the like.

Other lubricating oil additives can be employed in the lubricating oil compositions of the present invention. Examples of such additives are viscosity index improvers, antiwear agents, antioxidants, lubricating agents, antirust agents, extreme pressure agents, pour point depressants, m dispersants, dyes, and other conventionally used additives in lubricating oils.

In view of the above, according to the present invention, there is provided a process for the preparation of an overbased sulfurized alkaline earth metal alkylphenate product characterized by its bright stock solubility and its ability to provide reduced foam stability, which process comprises: (a) heating a first mixture of an alkylphenol having an alkyl group containing from about 8 to about 40 carbon atoms, elemental sulfur, a dihydric alcohol containing from 2 to 6 carbon atoms per molecule, an alkaline earth metal compound, a lubricating oil, and a high boiling point linear monohydric alcohol having from about 18 to about 60 carbon atoms per molecule, the mole ratio of said high boiling point linear monohydric alcohol to said alkylphenol being within the range of about 0.01 to about 0.1 mole of monohydric alcohol per mole of alkylphenol, to a first temperature within the range of about 121° C. (250° F.) to about 204° C. (400° F.) and maintaining said first mixture at said first temperature for a period of time within the range of about 1 hr to about 5 hr to effect thereby sulfurization and metal addition and to form an intermediate product mixture; (b) contacting said intermediate product mixture with carbon dioxide at a second temperature that is below 193° C. (380° F.) to provide a carbonated product mixture; (c) removing substantially all of the remaining water of reaction and large portions of the unreacted alkylphenol and of the unreacted dihydric alcohol from said carbonated product mixture to provide a final product mixture; and (d) recovering said final product mixture containing said overbased sulfurized alkaline earth metal alkylphenate and substantially all of said high boiling point linear monohydric alcohol that was employed in said first mixture.

There are also provided the products of the above process and each of the lubricating oil compositions comprising a major amount of a lubricating oil and an additive effective amount of the final product mixture of the process of the present invention.

The following examples are presented for the purpose of illustration only and are not intended to limit the scope of the present invention.

EXAMPLES 1-3

In each of these three examples, an overbased sulfurized calcium dodecylphenate was prepared according to the following general method of preparation and the amounts of reactants listed in Table II hereinbelow. The composition prepared in Example 1 did not contain a monohydric alcohol and, hence, is a comparative example.

In each case, appropriate amounts of dodecylphenol, sulfur, lime, ethylene glycol, high boiling point monohydric alcohol (if used), and a 5W oil were charged into a one-liter resin kettle equipped with an agitator system and the resultant feed mixture was heated to a temperature of 182° C.(360° F. and held at that temperature for 1 hr. Then a second charge of ethylene glycol and lime was added to the kettle and the resultant mixture was carbonated with carbon dioxide at a rate of 0.2 liter of carbon dioxide per minute until saturation. Subsequently, a third charge consisting of lime was added to the kettle and the resultant mixture was carbonated with carbon dioxide at a rate of 0.2 liter of carbon dioxide per minute until saturation. Then the mixture was heated to a temperature of 243° C.(470° F.) and stripped with nitrogen at a nitrogen rate of 0.2 liter per minute under a 10-inch mercury vacuum until 60 ml of overhead oil was obtained. The nitrogen stripping was continued without vacuum until a total of 1-hour stripping time was obtained. Then 50 ml of the 5W oil were added to the kettle and its contents were filtered with Celite on a Buchner filter.

The amounts of materials employed in the preparation of the overbased sulfurized calcium dodecylphenate in each of these examples are presented hereinbelow in Table II. Also presented in Table II are various analytical results obtained with each of the products and the test results for each product for foam stability according to ASTM Procedure D892 and for Bright Stock Solubility according to a one-day ambient storage test with 27 wt % of the overbased sulfurized phenate in an Amoco International laboratory reference oil SN 850008, Amoco Corporation, Chicago, Ill.

TABLE II

OPERATING AND TEST DATA

| Example | 1 | 2 | 3 |
|---|---|---|---|
| First Reactant Charge, gm | | | |
| Dodecylphenol | 210.0 | 210.0 | 210.0 |
| Sulfur | 37.1 | 37.1 | 37.1 |
| Lime | 43.8 | 43.8 | 43.8 |
| Glycol | 34.7 | 34.7 | 34.7 |
| Additive | | | |
| Alfol (Trademark) $C_{20+}$ alcohol | 0.0 | 10.0 | 0.0 |
| Octadecanol | 0.0 | 0.0 | 10.0 |
| 5W Oil | 200.0 | 190.0 | 190.0 |
| Second Reactant Charge, gm | | | |
| Glycol | 39.7 | 39.7 | 39.7 |
| Lime | 18.9 | 18.9 | 18.9 |
| Carbon Dioxide to saturation | | | |
| Third Reaction Charge, gm | | | |
| Lime | 18.9 | 18.9 | 18.9 |
| Carbon Dioxide to saturation | | | |
| Stripping Time to 60 ml Overhead Oil, min | 55 | 15 | 15 |
| Residual Reaction Solids, vol % | 4 | 2 | 2 |
| Filtration Rate | Slow | Fast | Fast |
| Product Analysis | | | |
| Calcium, wt % | 9.5 | 9.9 | 10.0 |
| Sulfur, wt % | 3.3 | 3.2 | 3.3 |
| TBN | 264 | 278 | 275 |
| Viscosity, cst at 100° C. | 264 | 118 | 126 |
| Bright Stock Solubility(1) | Hazy | Clear | Clear |
| Foam Stability, ml(2) | 165 | 0 | 0 |

(1)in Amoco reference oil SN 850008
(2)in Mobil reference oil 1823C for marine diesel applications (Mobil Oil Corporation, New York, NY)

The data presented in Table II indicated that the additives of Examples 2 and 3 significantly reduced residual reaction solids, enhanced stripping, and increased the filtration rate. According to the data, the additives provided products having higher TBN (Total Base Number), less viscosity, better bright stock solubility, and reduced foam stability.

EXAMPLE 4

In order to demonstrate that the $C_{18}$ to $C_{60}$ linear monohydric alcohols can be added to an overbased sulfurized alkaline earth metal alkylphenate as a post treatment to improve its bright stock solubility, the following data were generated.

A commercially prepared overbased sulfurized calcium dodecylphenate was employed in each of Samples 4 through 8. Each sample contained 27 wt % of the overbased sulfurized phenate in Amoco reference oil SN 850008. For Samples 5 through 8, the phenate was spiked with the additive shown and in the amount shown hereinbelow in Table III.

TABLE III

POSTTREATMENT OF OVERBASED SULFURIZED CALCIUM PHENATE

| Sample | Additive | Treat Rate, Wt % in Phenate | Bright Stock Solubility |
|---|---|---|---|
| 4 | None | 0.0 | Very Hazy |
| 5 | Alfol (Trademark) $C_{20+}$ Alcohol | 0.7 | Bright & Clear |
| 6 | Octadeconol | 0.7 | Bright & Clear |
| 7 | Stearic Acid | 1.5 | Bright & Clear |
| 8 | Ethylene Glycol | 2.5 | Bright & Clear |

While each of the additives improved the bright stock solubility of the phenate in the reference oil, the two linear monohydric alcohol additives were found to be the most effective for the posttreatment.

Hence, a post treatment of an overbased sulfurized alkaline earth metal alkylphenate with from about 0.5 wt % to about 5 wt % $C_{18}$ to $C_{60}$ linear monohydric alcohol, based on the weight of phenate, preferably about 0.5 wt % to about 2 wt %, is sufficient to greatly improve the bright stock solubility of the phenate.

Some of the effects provided by the high boiling point linear $C_{18}$–$C_{60}$ monohydric alcohols can be observed with sulfonates, carboxylic acids, and other polar compounds. Any long-chain molecule with one or more polar ends might work to some extent. However, the high boiling point linear alcohols remain virtually intact during the process of the present invention, while sulfonates and carboxylic acids, in one way or another, are reacted in the process. The presence of the additive in the final product is needed to provide the improved bright stock solubility and reduced foam stability.

What is claimed is:

1. A process for the preparation of an overbased sulfurized alkaline earth metal alkylphenate product characterized by its bright stock solubility and its ability to provide reduced foam stability, which process essentially consists of: (a) heating a first mixture of an alkylphenol having an alkyl group containing from about 8 to about 40 carbon atoms, elemental sulfur, a dihydric alcohol containing from 2 to 6 carbon atoms per molecule, an alkaline earth metal compound, a lubricating oil, and a high boiling point linear monohydric alcohol having from about 18 to about 60 carbon atoms per molecule, the mole ratio of said high boiling point linear monohydric alcohol to said alkylphenol being within the range of about 0.01 to about 0.1 mole of monohydric alcohol per mole of alkylphenol, and said monohydric alcohol comprises about 2 to 10% by weight of said alkylphenol, to a first temperature within the range of about 121° C. (250° F.) to about 204° C. (400° F.) and maintaining said first mixture at said first temperature for a period of time within the range of about 1 hr to about 5 hr to effect thereby sulfurization and metal addition and to form an intermediate product mixture; (b) contacting said intermediate product mixture with carbon dioxide at a second temperature that is below 193° C. (380° F.) to provide a carbonated product mixture; (c) removing substantially all of the remaining water of reaction and large portions of the unreacted alkylphenol and of the unreacted dihydric alcohol from said carbonated product mixture to provide a final product mixture; and (d) recovering said final product mixture comprising said overbased sulfurized alkaline earth metal alkylphenate and substantially all of said high boiling point linear monohydric alcohol that was employed in said first mixture.

2. The process of claim 1 wherein said sulfur is used in an amount within the range of about 1 to about 2 moles of sulfur per mole of alkylphenol, said alkaline earth metal compound is used in an amount within the range of about 1.2 to about 2 moles of alkaline earth metal compound per mole of alkylphenol, said dihydric alcohol is used in an amount within the range of about 1 to about 2 moles of dihydric alcohol per mole of alkylphenol, said carbon dioxide is used in amount within the range of about 0.5 to about 1.3 moles of carbon dioxide per mole of alkylphenol, and said lubricating oil is present in an amount within the range of about 20 to about 40 wt % of the weight of the total reaction mixture.

3. The process of claim 1 wherein about 30 to about 50 wt % of the total amount of said dihydric alcohol and about 30 to about 100 wt % of the total amount of said alkaline earth metal compound are used in forming said first mixture and the remaining amounts of about 70 to about 50 wt % of said dihydric alcohol and about 70 to about 0 wt % of said alkaline earth metal compound are used in said process prior to or during said contacting said intermediate product mixture with carbon dioxide.

4. The process of claim 1, wherein said removing substantially all of the remaining water of reaction and large portions of the unreacted alkylphenol and of the unreacted dihydric alcohol from said carbonated product mixture is carried out by contacting said carbonated product mixture with nitrogen at a temperature within the range of about 204° C. (400° F.) to about 260° C. (500° F.) for a period of time within the range of about 0.5 to about 1 hr so as to strip said water of reaction, said unreacted alkylphenol, and said unreacted dihydric alcohol from said carbonated product mixture and to form a stripped product mixture.

5. The process of claim 1, wherein said process is a continuous process.

6. The overhead sulfurized alkaline earth metal alkylphenate final product mixture obtained from the process of claim 1.

7. The process of claim 1, wherein said alkaline earth metal compound is selected from the oxide or hydroxide of calcium, or barium, or magnesium; said dihydric alcohol is selected from the group consisting of ethylene glycol, propylene glycol, butane diol-2,3, pentane diol-2,3, and 3-methylbutane diol-1,2; and said alkylphenol is an alkylphenol having the formula $R(C_6H_4)OH$, said R being a straight chain or branched chain alkyl group having 10 to 30 carbon atoms.

8. The process of claim 2 wherein said alkaline earth metal compound is selected from the oxide or hydroxide of calcium, barium, or magnesium; said dihydric alcohol is selected from the group consisting of ethylene, glycol, propylene glycol, butane diol-2,3, pentane diol-2,3, and 3-methylbutane diol-1,2; and said alkylphenol is an alkylphenol having the formula $R(C_6H_4)OH$, said R being a straight chain or branched chain alkyl group having 10 to 30 carbon atoms.

9. The process of claim 2 wherein about 30 wt % to about 50 wt % of the total amount of said dihydric alcohol and about 30 wt % to about 100 wt % of the total amount of said alkaline earth metal compound are used in forming said first mixture and the remaining amounts of about 70 wt % to about 50 wt % of said dihydric alcohol and about 70 wt % to about 0 wt % of said alkaline earth metal compound are used in said process prior to or during said contacting said intermediate product mixture with carbon dioxide.

10. The process of claim 2 wherein said alkaline earth metal compound is the oxide or hydroxide of calcium, said dihydric alcohol is ethylene glycol, said alkylphenol is dodecylphenol, and said monohydric alcohol is Alfol (Trademark) $C_{20+}$ alcohol.

11. The process of claim 4 wherein said stripped product mixture is filtered at a temperature within the range of about 149° C. (300° F.) to about 204° C. (400° F.) to obtain said final product mixture comprising said overbased sulfurized alkaline earth metal alkylphenate and substantially all of said high boiling point linear monohydric alcohol that was employed in said first mixture.

12. A lubricating oil composition comprising a major amount of a lubricating oil and an additive effective amount of the overbased sulfurized alkaline earth metal alkylphenate final product mixture of claim 6.

13. The process of claim 8 wherein said removing substantially all of the remaining water of reaction and large portions of the unreacted alkylphenol and of the unreacted dihydric alcohol from said carbonated product mixture is carried out by contacting said carbonated product mixture with nitrogen at a temperature within the range of about 204° C. (400° F.) to about 260° C. (500° F.) for a period of time within the range of about 0.5 hr to about 1 hr so as to strip said water of reaction, said unreacted alkylphenol, and said unreacted dihydric alcohol from said carbonated product mixture and to form a stripped product mixture and said stripped product mixture is filtered at a temperature within the range of about 149° C. (300° F.) to about 204° C. (400° F.) to obtain said final product mixture comprising said overbased sulfurized alkaline earth metal alkylphenate and substantially all of said high boiling point linear monohydric alcohol that was employed in said first mixture.

14. The process of claim 9 wherein said alkaline earth metal compound is selected from the oxide or hydroxide of calcium, barium, or magnesium; said dihydric alcohol is selcted from the group consisting of ethylene glycol, propylene glycol, butane diol-2,3, pentane diol-2,3, and 3-methylbutane diol-1,2; and said alkylphenol is an alkylphenol having the formula $R(C_6H_4)OH$, said R being a straight-chain or branched-chain alkyl group having 10 to 30 carbon atoms.

15. The process of claim 9 wherein said alkaline earth metal compound is the oxide or hydroxide of calcium, said dihydric alcohol is ethylene glycol, said alkylphenol is dodecylphenol, and said monohydric alcohol is Alfol (Trademark) $C_{20+}$ alcohol.

16. The process of claim 10 wherein said removing substantially all of the remaining water of reaction and large portions of the unreacted alkylphenol and of the unreacted dihydric alcohol from said carbonated product mixture is carried out by contacting said carbonated product mixture with nitrogen at a temperature within the range of about 204° C. (40° F.) to about 260° C. (500° F.) for a period of time within the range of about 0.5 to about 1 hr so as to strip said water of reaction, said unreacted alklyphenol, and said unreacted dihydric alcohol from said carbonated product mixture and to form a stripped product mixture and said stripped product mixture is filtered at a temperature within the range of about 140° C. (300° F.) to about 204° C. (400° F.) to obtain said final product mixture comprising said overbased sulfurized alkaline earth metal alkylphenate and substantially all of said high boiling point linear monohydric alcohol that was employed in said first mixture.

17. The overbased sulfurized alkaline earth metal alkylphenate final product mixture obtained from the process of claim 13.

18. The process of claim 14 wherein said removing substantially all of the remaining water of reaction and large portions of the unreacted alkylphenol and of the unreacted dihydric alcohol from said carbonated product mixture is carried out by contacting said carbonated product mixture with nitrogen at a temperature within the range of about 204° C. (400° F.) to about 260° C. (500° F.) for a period of time within the range of about 0.5 hr to about 1 hr so as to strip said water of reaction, said unreacted alkylphenol, and said unreacted dihydric alcohol from said carbonated product mixture and to form a stripped product mixture and said stripped product mixture is filtered at a temperature within the range of about 140° C. (300° F.) to about 204° C. (400° F.) to obtain said final product mixture comprising said overbased sulfurized alkaline earth metal alkylphenate and substantially all of said high boiling point linear monohydric alcohol that was employed in said first mixture.

19. The process of claim 15 wherein said removing substantially all of the remaining water of reaction and large portions of the unreacted alkylphenol and of the unreacted dihydric alcohol from said carbonated product mixture is carried out by contacting said carbonated product mixture with nitrogen at a temperature within the range of about 204° C. (400° F.) to about 260° C. (500° F.) for a period of time within the range of about 0.5 hr to about 1 hr so as to strip said water of reaction, said unreacted alkylphenol, and said unreacted dihydric alcohol from said carbonated product mixture and to form a stripped product mixture and said stripped product mixture is filtered at a temperature within the range of about 149° C. (300° F.) to about 204° C. (400° F.) to obtain said final product mixture comprising said overbased sulfurized alkaline earth metal alkylphenate and substantially all of said high boiling point linear monohydric alcohol that was employed in said first mixture.

20. The overbased sulfurized alkaline earth metal alkylphenate final product mixture obtained from the process of claim 16.

21. A lubricating oil composition comprising a major amount of a lubricating oil and an additive effective amount of the overbased sulfurized alkaline earth metal alkylphenate final product mixture of claim 17.

22. The overbased sulfurized alkaline earth metal alkylphenate final product mixture obtained from the process of claim 18.

23. The overbased sulfurized alkaline earth metal alkylphenate final product mixture obtained from the process of claim 19.

24. A lubricating oil composition comprising a major amount of a lubricating oil and an additive effective amount of the overbased sulfurized alkaline earth metal alkylphenate final product mixture of claim 20.

25. A lubricating oil composition comprising a major amount of a lubricating oil and an additive effective amount of the overbased sulfurized alkaline earth metal alkylphenate final product mixture of claim 22.

26. A lubricating oil composition comprising a major amount of a lubricating oil and an additive effective amount of the overbased sulfurized alkaline earth metal alkylphenate final product mixture of claim 23.

27. A process for the preparation of an overbased sulfurized calcium dodecylphenate product characterized by its bright stock solubility and its ability to provide reduced foam stability, which process essentially consists of: (a) heating a first mixture of dodecylphenol, elemental sulfur, ethylene glycol, lime, a lubricating oil, and Alfol (Trademark) $C_{20+}$ alcohol, the mole ratio of said Alfol (Trademark) $C_{20+}$ alcohol to said dodecylphenol being within the range of about 0.02 to about 0.05 mole of monohydric alcohol per mole of alkylphenol, and said monohydric alcohol comprises about 2 to 5% by weight of said alkylphenol, to a first temperature within the range of about 166° C. (330° F.) to about 188° C. (370° F.) and maintaining said first mixture of said first temperature for a period of time within the range of about 1 hr to about 5 hr to effect thereby sulfurization and metal addition and to form an intermediate product mixture; (b) contacting said intermediate product mixture with carbon dioxide at a second temperature that is below 193° C. (380° F.) to provide a carbonated product mixture; (c) removing substantially all of the remaining water of reaction and large portions of the unreacted dodecylphenol and of the unreacted ethylene glycol from said carbonated product mixture by contacting said carbonated product mixture with nitrogen at a temperature within the range of about 232° C. (450° F.) to about 260° C. (500° F.) for a period of time within the range of about 0.5 hr to about 1 hr so as to strip said water of reaction, said unreacted dodecylphenol, and said unreacted ethylene glycol from said carbonated product mixture and to form a stripped product mixture; and (d) filtering said stripped product mixture at a temperature within the range of about 149° C. (300° F.) to about 204° C. (400° F.) to recover a final product mixture comprising said overbased sulfurized calcium dodecylphenate and substantially all of said Alfol (Trademark) $C_{20+}$ alcohol that was employed in said first mixture, said sulfur being used in an amount within the range of about 1.3 to about 1.6 moles of sulfur per mole of alkylphenol, said lime being used in an amount within the range of about 1.6 to about 1.8 moles of calcium hydroxide per mole of alkylphenol, said ethylene glycol being used in an amount within the range of about 1.2 to about 1.7 moles of ethylene glycol per mole of alkylphenol, and said carbon dioxide being used in an amount within the range of about 0.9 to about 1.1 moles of carbon dioxide per mole of alkylphenol.

28. The overbased sulfurized calcium dodecylphenate final product mixture obtained from the process of claim 27.

29. A lubricating oil composition comprising a major amount of a lubricating oil and an additive effective amount of the overbased sulfurized calcium dodecylphenate final product mixture of claim 28.

* * * * *

UNITED STATES PATENT OFFICE
CERTIFICATE OF CORRECTION

Patent No. 4,664,824 Dated May 12, 1987

Inventor(s) Yuehsiung Chang & Larry C. Satek

It is certified that error appears in the above-identified patent and that said Letters Patent are hereby corrected as shown below:

Column 13, line 64, "(40°F.)" should be --(400°F.)--

Signed and Sealed this

Eleventh Day of August, 1987

*Attest:*

DONALD J. QUIGG

*Attesting Officer*

*Commissioner of Patents and Trademarks*